US006500288B2

(12) United States Patent
Hara et al.

(10) Patent No.: US 6,500,288 B2
(45) Date of Patent: Dec. 31, 2002

(54) ROLL FILM CONNECTING DEVICE AND METHOD

(75) Inventors: Toshiyuki Hara, Tokushima (JP); Mitsuhiko Tomita, Tokushima (JP); Seiji Hashimoto, Tokushima (JP); Michio Ueda, Tokushima (JP)

(73) Assignee: Shikoku Kakoki Co., Ltd., Itano-Gun (JP)

( * ) Notice: Subject to any disclaimer, the term of this patent is extended or adjusted under 35 U.S.C. 154(b) by 115 days.

(21) Appl. No.: 09/788,549

(22) Filed: Feb. 21, 2001

(65) Prior Publication Data

US 2001/0016120 A1 Aug. 23, 2001

(30) Foreign Application Priority Data

Feb. 23, 2000 (JP) ..... 2000-045860

(51) Int. Cl.[7] ..... B65H 21/00

(52) U.S. Cl. ..... 156/159; 156/157; 156/502; 156/504; 156/505; 242/553; 242/556.1

(58) Field of Search ..... 156/157, 159, 156/502, 504, 505; 242/551, 552, 553, 556.1

(56) References Cited

U.S. PATENT DOCUMENTS 3,440,126 A * 4/1969 Bartholomay et al. ..... 156/505
4,157,934 A * 6/1979 Ryan et al. ..... 156/504
4,331,301 A * 5/1982 Martinez ..... 156/502
5,411,223 A * 5/1995 Gatteschi ..... 242/551
5,738,744 A * 4/1998 Washizaki et al. ..... 156/159
6,142,408 A * 11/2000 Focke et al. ..... 242/553

FOREIGN PATENT DOCUMENTS

JP 53-11694 2/1978
JP 5-97122 4/1993

* cited by examiner

*Primary Examiner*—Mark A. Osele
(74) *Attorney, Agent, or Firm*—Armstrong, Westerman & Hattori, LLP

(57) ABSTRACT

A roll film connecting device comprises means for transporting a preceding film and a film following the film via a connecting station, a pair of connecting members arranged at the connecting station and movable toward or away from each other with a film transport path positioned therebetween, each of the connecting members having a face opposed to the other and serving as a suction face, a pair of cutters so arranged as to be movable out of or into the respective suction faces of the connecting members, and a cutter receiver so disposed as to be movable into or out of a space between the connecting members as moved away from each other.

5 Claims, 5 Drawing Sheets

ROLL FILM CONNECTING DEVICE AND METHOD

BACKGROUND OF THE INVENTION

The present invention relates to a device for and a method of connecting roll films to each other, for example, for use in liquid filling machines as a closure material.

As disclosed in JP-A 53-11694 (1978), a device of the type mentioned is already known which comprises means for transporting a preceding film and a film following the film via a joining station, a pair of joining members arranged at the joining station on respective opposite sides of a film transport path, a pair of cutters positioned upstream from the joining members with respect to the direction of transport of the film and arranged on respective opposite sides of the film transport path so as to be movable toward or away from each other, and a cutter receiver fixedly disposed between the cutters. The following film is joined to the preceding film by the joining members, and the portion of the preceding film remaining is cut off by the cutters.

The films joined by the conventional device have a lap at the joint, and a length of the preceding film corresponding to the distance of the cutters from the connecting members extends from the joint as an unnecessary portion. The lap and the unnecessary portion not only result in a waste of film but are likely to bite into the device.

JP-A 5-97122 (1993) discloses a roll film connecting device which comprises means for transporting a preceding film and a film following the film via a connecting station, a pair of connecting members arranged at the connecting station and movable toward or away from each other with a film transport path positioned therebetween, each of the connecting members having a face opposed to the other and serving as a suction face, and actuating means for moving the connecting members toward each other upon detecting the rear end of the preceding film as brought nearly to the space between the connecting members. A connecting tape is affixed to the leading end of the following film so as to partly extend downstream beyond the leading end with respect to the direction of transport of the tape, and the partly extending portion of the connecting tape is caused to be attracted to the corresponding connecting member by suction.

With this conventional device, the accuracy of the joint of the two films is dependent on the timing of moving the two connecting members toward each other. If this timing is too early, the two films lap over each other, whereas if the timing is too late, a clearance will occur between the two films. Thus it is difficult to connect the two films together accurately end-to-end. If it is attempted to position the films accurately relative to each other, the control mechanism therefor tends to become complex.

SUMMARY OF THE INVENTION

An object of the present invention is to overcome the foregoing problems and to provide a device for and a method of connecting roll films, by which the rear end of the preceding film can be connected to the leading end of the following film accurately by a simple construction.

The present invention provides a roll film connecting device comprising means for transporting a preceding film and a film following the film via a connecting station, a pair of connecting members arranged at the connecting station and movable toward or away from each other with a film transport path positioned therebetween, each of the connecting members having a face opposed to the other and serving as a suction face, a pair of cutters so arranged as to be movable out of or into the respective suction faces of the connecting members, and a cutter receiver so disposed as to be movable into or out of a space between the connecting members as moved away from each other.

With the roll film connecting device of the present invention, the cutter receiver is advanced into the space between the pair of connecting members, and the preceding film is cut by the cutter as projected from the suction face of the corresponding connecting member and by the cutter receiver. The two films are connected together by the connecting members, with the cutter receiver retracted from the space between the connecting members. Since the preceding film is cut and connected to the following film at one location, the films can be positioned easily relative to each other, with the result that the rear end of the preceding film can be connected to the leading end of the following film with high accuracy.

When each of the connecting members comprises a pair of vacuum pipes arranged at respective opposite sides of the cutter and each having suction holes formed in a suction face thereof, the cutter can be easily moved out of or into the suction face of the connecting member by a simple construction.

When each of the connecting members is attached to a movable frame along with the cutter, the connecting member and the cutter can be moved together. This also serves to give improved accuracy to the connection.

Further when a fluid pressure cylinder is provided between the cutter and the movable frame, the cutter is movable independently of the movement of the connecting member and can therefore be operated at desired timing.

In connecting the following film to the preceding film by the roll film connecting device described, a connecting tape is affixed to the leading end of the following film so as to partly extend downstream beyond the leading end with respect to the direction of transport of the tape, and the partly extending portion of the connecting tape is caused to be attracted to the corresponding connecting member by suction, whereby the rear end of the preceding film can be connected to the leading end of the following film in the manner of a butt joint.

DETAILED DESCRIPTION OF THE PREFERRED EMBODIMENT

An embodiment of the present invention will be described below with reference to the drawings.

Figure 1:
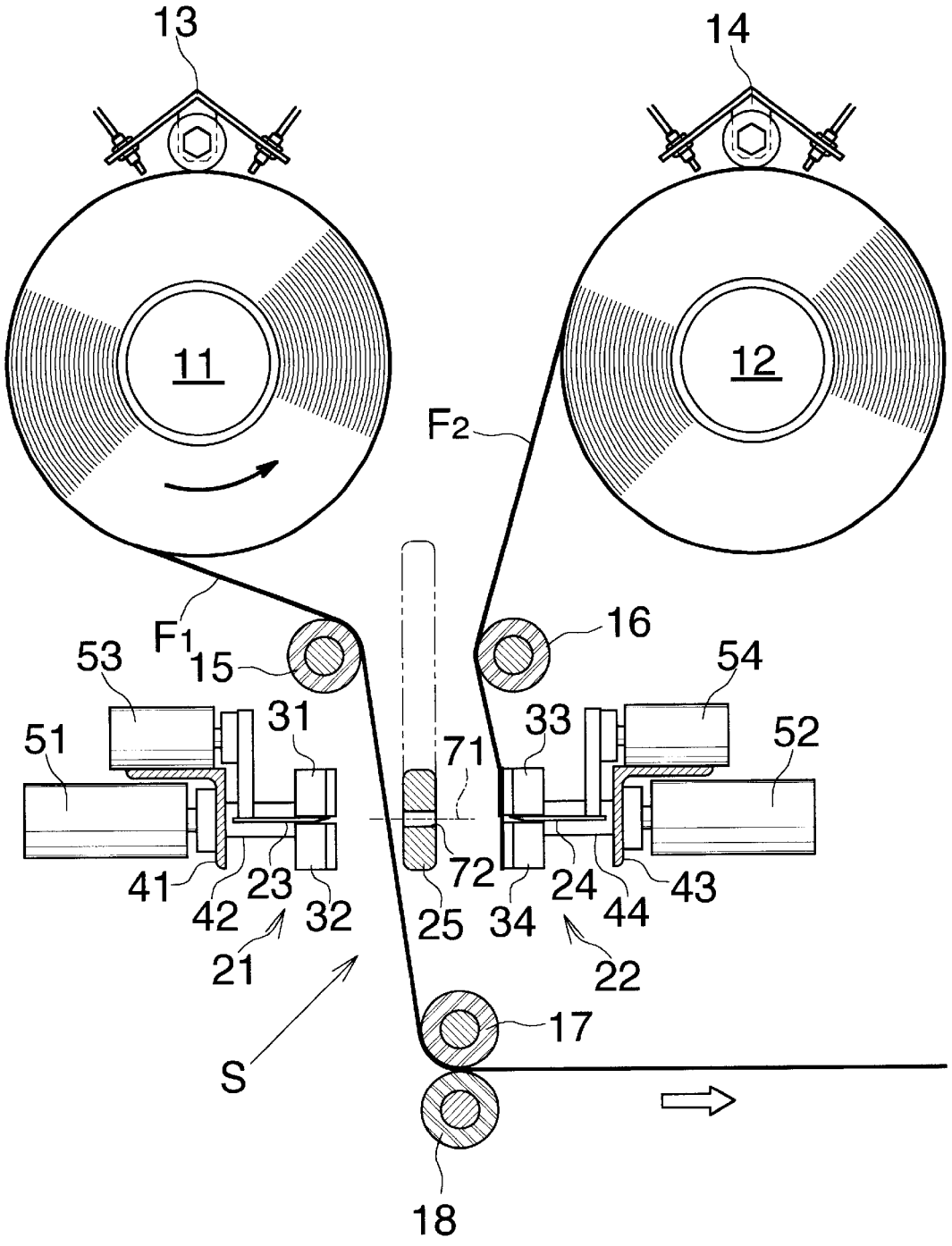
FIG. 1 is a front view showing a film connecting device of the invention.

FIG. 1 shows a left rewinder 11 having a preceding film F1 supported thereon, and a right rewinder 12 disposed in parallel to the rewinder 11 and having supported thereon a film F2 following the film F1.

The preceding film F1 and the following film F2 are of the same type and made from polyethylene and have a thickness of about 0.5 mm for use as a closure material. The rewinders 11, 12 are provided with respective left and right rear end sensors 13, 14.

Arranged below the two rewinders 11, 12 are left and right guide rollers 15, 16 which are horizontally spaced apart from each other. A feed roller 17 and a holding roller 18 are arranged one above another, as positioned below the space between the guide rollers 15, 16.

A connecting station S is provided between the pair of guide rollers 15, 16 and the pair of feed and holding rollers 17, 18. Arranged at the station are pair of left and right connecting members 21, 22 so as to be movable toward or away from each other, and a pair of cutters 23, 24 which are similarly movable. When these components are moved away, a cutter receiver 25 is movable into or out of the space therebetween.

The preceding film F1 is guided downward from the left rewinder 11, reeved around the left guide roller 15, passed between the feed roller 17 and the holding roller 18 and thereafter sent to an unillustrated filling machine. The following film F2 is guided downward from the right rewinder 12, reeved around the right guide roller 16 and held in a standby position with its leading end guided to the right connecting member 22.

The left connecting member 21 comprises horizontal first and second vacuum pipes 31 32 arranged one above the other in parallel, with a cutter insertion clearance provided therebetween. Like the left connecting member 21, the right connecting member 22 comprises third and fourth vacuum pipes 33, 34.

The first and second vacuum pipes 31, 32 are connected to the outer end of a left support arm 42 extending rightward from a horizontal left movable frame 41 which is L-shaped in cross section. The third and fourth vacuum pipes 33, 34 are directed toward the opposite direction to the first and second vacuum pipes 31, 32 transversely of the device (with respect to left-right direction), but identical with the pipes 31, 32 in construction, and attached to a right movable frame 43 by a right support arm 44.

The left movable frame 41 is attached to the piston rod of a first fluid pressure cylinder 51 which is mounted as directed rightward by unillustrated means. The right movable frame 43 is attached to the piston rod of a second fluid pressure cylinder 52 which is directed leftward.

The left cutter 23 is in the form of a horizontal plate so disposed as to be movable leftward and rightward between the first and second vacuum pipes 31, 32, and is attached by a depending left bracket to the piston rod of a third fluid pressure cylinder 53 mounted as directed rightward on the left movable frame 41. The right cutter 24 is in the form of a horizontal plate so disposed as to be movable leftward and rightward between the third and fourth vacuum pipes 33, 34, and is attached by a depending right bracket to the piston rod of a fourth fluid pressure cylinder 54 mounted as directed leftward on the right movable frame 43.

Figure 2:
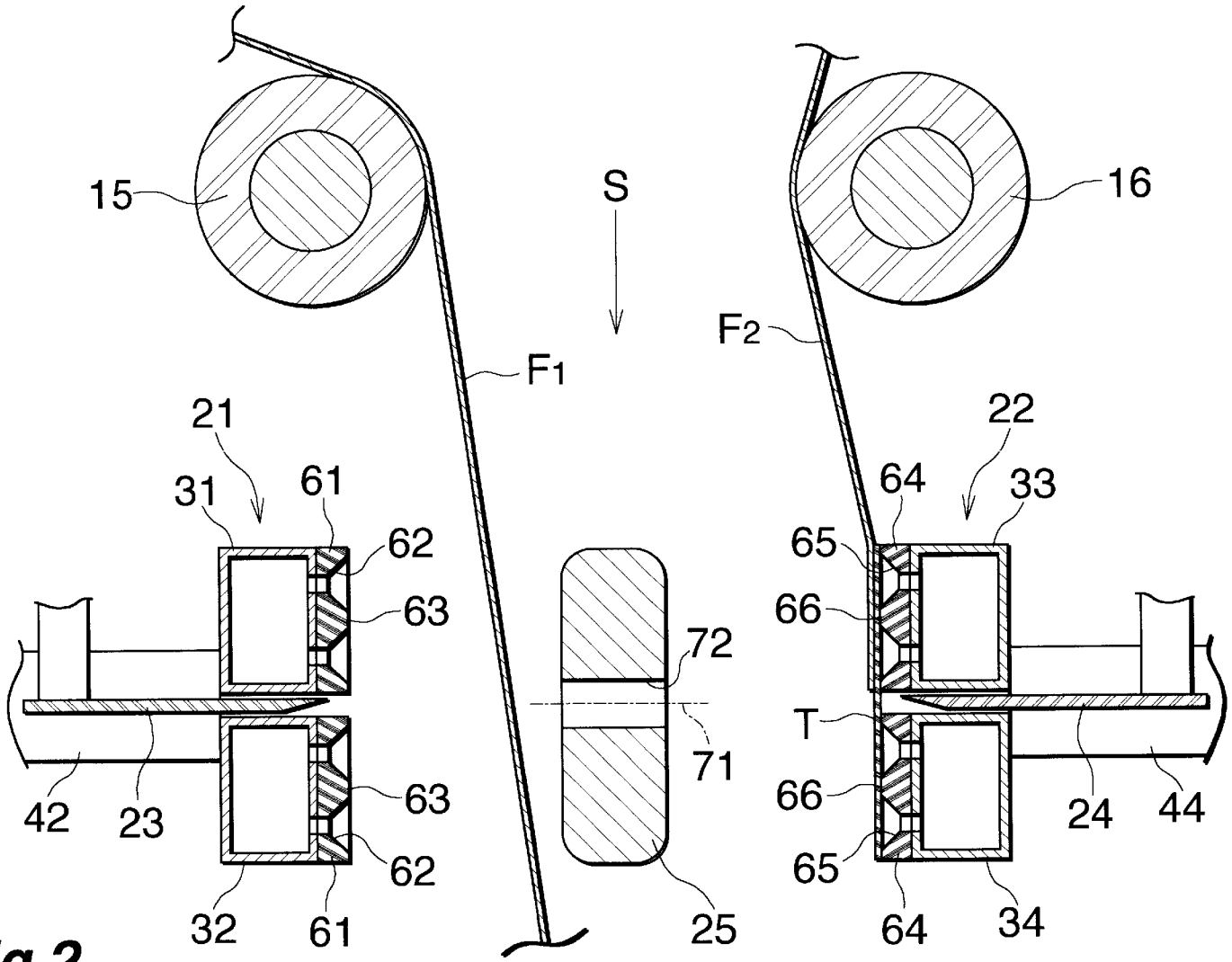
FIG. 2 is a fragmentary view in vertical section of the device.

With reference to FIG. 2, a left cushion member 61 is affixed to the right side face of each of the first and second vacuum pipes 31, 32. A plurality of left suction bores 62 extend straight through the left cushion member 61 and the right side wall of each of the first and second vacuum pipes 31, 32 for the right side face of the left cushion member 61 to provide a left suction face 63. A right cushion member 64 is affixed similarly to each of the third and fourth vacuum pipes 33, 34, and right suction bores 65 and a right suction face 66 are formed alike.

The cutter receiver 25 is in the form of a striplike plate and supported at one end thereof on a horizontal support axis 71 extending transversely of the device and positioned laterally of the cutters. The cutter receiver is pivotally movable by unillustrated means between a horizontal posture indicated in a solid line and a vertical posture indicated in a chain line in FIG. 1. The cutter receiver 25 has a cutter escape groove 72 formed at the widthwise midportion thereof and extending longitudinally thereof.

The films are connected together by the operation to be described below with reference to FIG. 3.

Figure 3A:
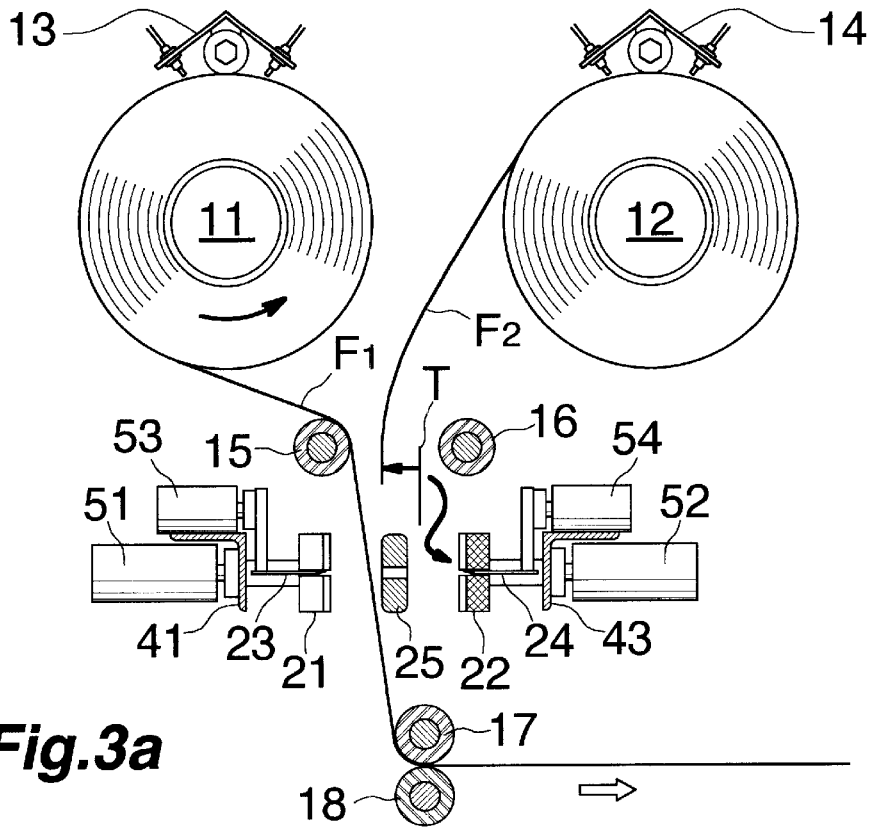
FIGS. 3*a,* 3*b,* 3*c,* 3*d,* 3*e,* 3*f* include diagrams for illustrating a connecting operation stepwise.

The preceding film F1 supported by the left rewinder 11 is shown in FIG. 3*a* while it is being transported. The piston rods of the first to fourth fluid pressure cylinders 51 to 54 are all retracted, and the left and right connecting members 21, 22, as well as the cutters 23, 24, are away from each other. The cutter receiver 25 is advanced into the space between these opposed components. In this state, the following film F2 is set on the right rewinder 12 anew. A connecting tape T is affixed to the leading end of the following film F2 and fixed to the right connecting member 22 by being attracted thereto by suction. This state is shown in detail in FIG. 2, in which the connecting tape T is positioned across the right suction face 66 of the third and fourth vacuum pipes 33, 34, the end of the following film F2 is positioned at the approximate same level as the right cutter 24, and the lower half of the connecting tape T extends beyond the following film F2. In this state, a vacuum is produced in the third and fourth vacuum pipes 33, 34, which are crosshatched to indicate the vacuum formed.

Figure 3B:
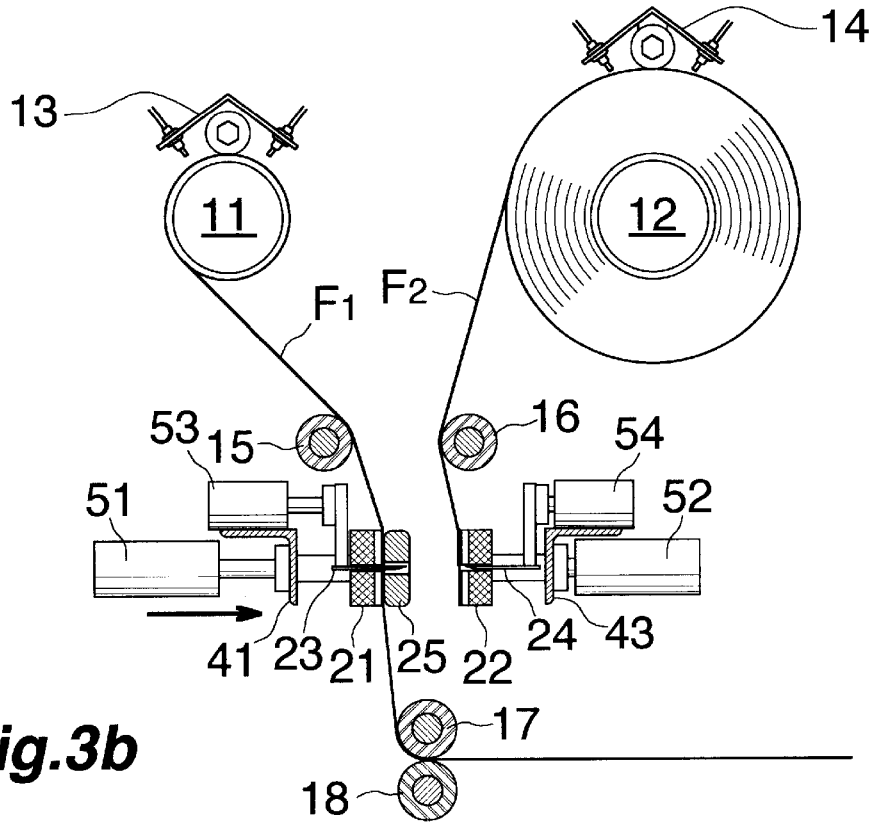

When the left rear end sensor 13 detects a reduction in the quantity of the preceding film F1 as shown in FIG. 3*b*, the transport of the preceding film F1 by the feed roller 17 and the holding roller 18 is halted. During the cessation of transport, the preceding film F1 is held loosened by an accumulator (not shown) downstream from the rollers 17, 18 and continuously fed to the filling machine.

Upon the cessation of transport of the preceding film F1, the piston rod of the first fluid pressure cylinder 51 is advanced to move the left connecting member 21 rightward along with the left cutter 23, pressing the left connecting member 21 against the cutter receiver 25 with the preceding film F1 interposed therebetween. The first and second vacuum pipes 31, 32 are actuated to form a vacuum. Subsequently, the piston rod of the third fluid pressure cylinder 53 is advanced to move the left cutter 23 further rightward, causing the outer end of the left cutter 23 to project rightward beyond the first and second vacuum pipes 31, 32, whereby the preceding film. F1 is cut by the left cutter 23.

Figure 3C:
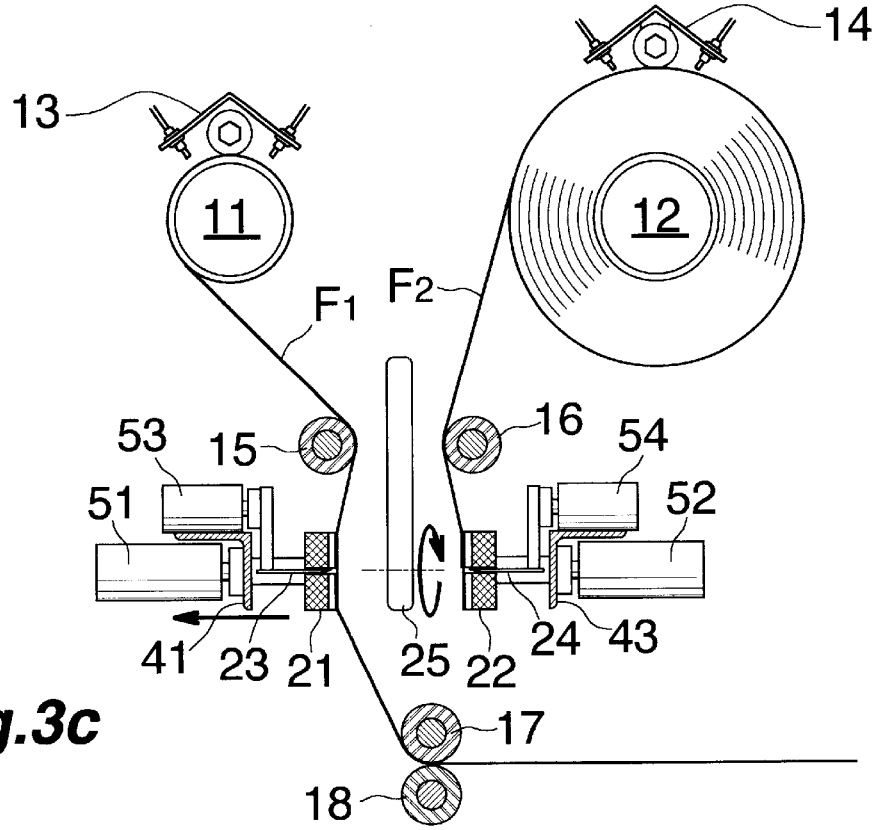

Upon the completion of cutting of the preceding film F1, the piston rods of the first and third fluid pressure cylinders 51, 53 are retracted to move the left connecting member 21 leftward with the cut preceding film F1 held attracted thereto as shown in FIG. 3*c*, and the left cutter 23 is concealed in the left connecting member 21. Approximately when the left connecting member 21 is returned to the original position away from the other connecting member, the cutter receiver 25 is pivotally moved upward and retracted from the space between the opposed connecting members 21, 22.

Figure 3D:
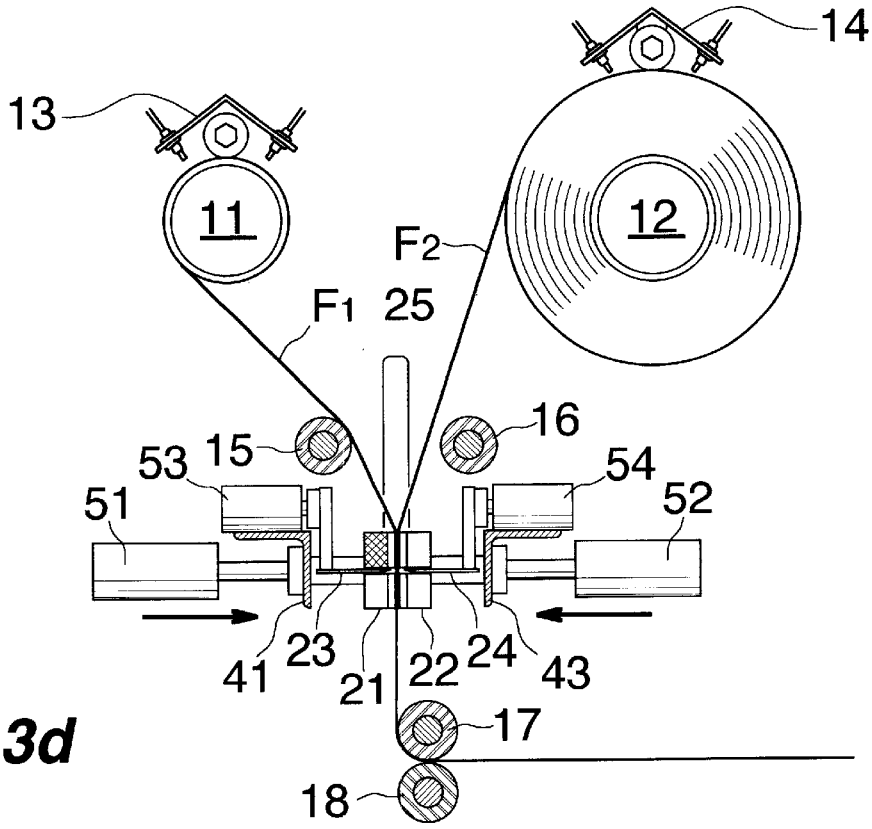

The first and second fluid pressure cylinders 51, 52 are then actuated to bring the left and right connecting members 21, 22 toward each other as seen in FIG. 3*d*. When the connecting members 21, 22 are pressed against each other, the end portion of the preceding film F1 downstream from the cut portion is joined to the extending portion of the connecting tape T, whereby the preceding film F1 and the following film F2 are connected together. The second to fourth vacuum pipes 32 to 34 are thereafter brought out of operation to eliminate the vacuum.

Figure 3E:
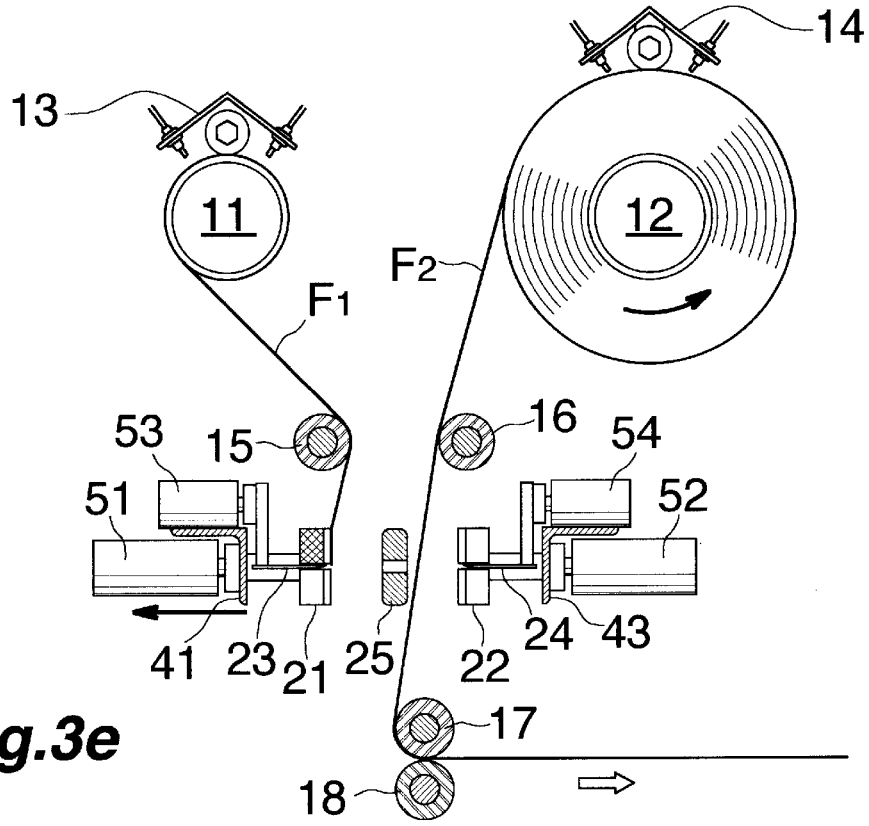

Subsequently, the piston rods of the first and second fluid pressure cylinders 51, 52 are retracted to move the opposed connecting members 21, 22 away from each other as shown in FIG. 3*e*. The cutter receiver 25 is pivotally moved downward and advanced into the space between the connecting members 21, 22 as positioned away from each other. The end portion of the preceding film F1 upstream from the cut portion is held attracted to the first vacuum pipe 31 by suction, whereas the preceding film F1 is connected to the following film F2 in a straight form, and the transport of the film F2 is started in this state. In this way, the films are completely connected together.

Figure 3F:
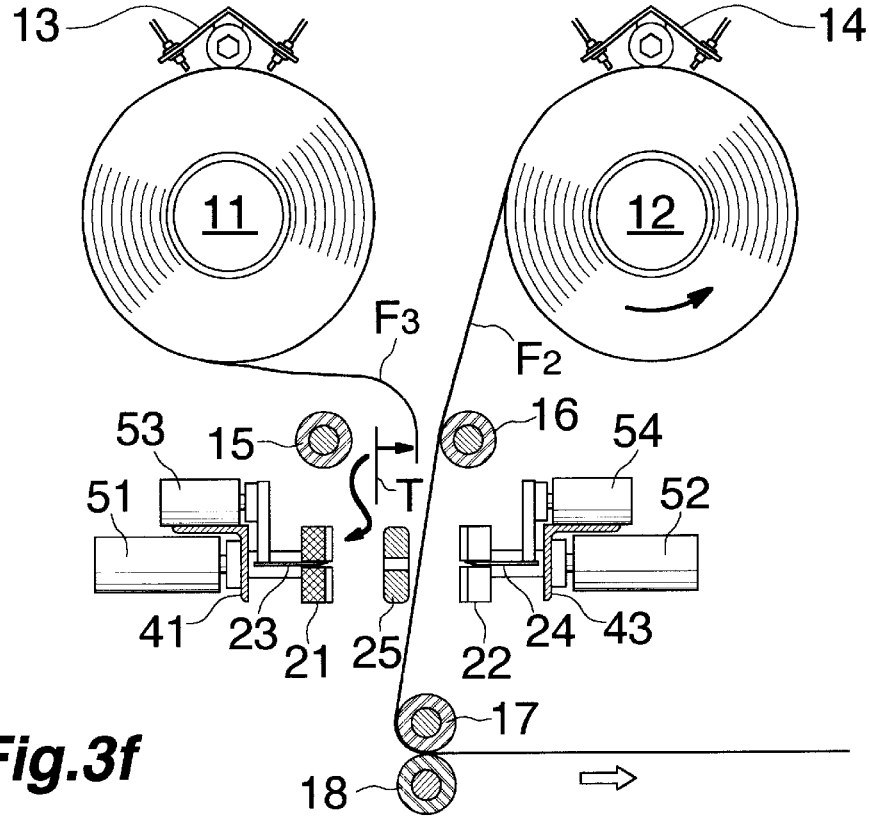

FIG. 3*f* shows a new film F3 as set in place on the left rewinder 11 and made ready for the subsequent connecting operation. A connecting film T is affixed to the leading end of the film F3 as previously described and held attracted to the left connecting member 21.

In the case where the film is provided with a position matching mark, known mark detecting means, control means, etc. are usable for the coincidence of the marks.

What is claimed is:

1. A roll film connecting device comprising:

means for transporting a preceding film and a film following the film via a connecting station, a pair of connecting members arranged at the connecting station and movable toward or away from each other with a film transport path positioned therebetween, each of the connecting members having a face opposed to the other and serving as a suction face, a pair of cutters so arranged as to be movable out of or into the respective suction faces of the connecting members, and a cutter receiver so disposed as to be movable into or out of a space between the connecting members as moved away from each other.

2. A roll film connecting device according to claim 1 wherein each of the connecting members comprises a pair of vacuum pipes arranged at respective opposite sides of the cutter and each having suction holes formed in a suction face thereof.

3. A roll film connecting device according to claim 1 or 2 wherein each of the connecting members is attached to a movable frame along with the cutter.

4. A roll film connecting device according to claim 3 wherein a fluid pressure cylinder is provided between the cutter and the movable frame.

5. A roll film connecting method for use in a roll film connecting device according to claim 1 or 2, wherein in connecting the following film to the preceding film, a connecting tape is affixed to a leading end of the following film so as to partly extend downstream beyond the leading end with respect to the direction of transport of the tape, and the partly extending portion of the connecting tape is caused to be attracted to the corresponding connecting member by suction.

* * * * *